US005214894A

United States Patent [19]

Glesser-Lott

[11] Patent Number: 5,214,894

[45] Date of Patent: Jun. 1, 1993

[54] WALL CONSTRUCTION OF A NON-LOAD-BEARING EXTERNAL WALL OF A BUILDING

[76] Inventor: Erika B. Glesser-Lott, Bruderholzrain 30, Basel, Switzerland, CH-4059

[21] Appl. No.: 826,445

[22] Filed: Jan. 27, 1992

[30] Foreign Application Priority Data

Feb. 1, 1991 [CH] Switzerland ..... 325/91

[51] Int. Cl.[5] ..... E04B 5/00

[52] U.S. Cl. ..... 52/408; 52/144

[58] Field of Search ..... 52/408, 409, 410, 144, 52/267, 268, 269, 249, 404; 428/326, 68

[56] References Cited

U.S. PATENT DOCUMENTS 2,363,068 11/1944 Leadbetter ..... 52/404 X
4,489,121 12/1987 Luckanuck ..... 428/326 X
4,882,880 11/1989 Moore ..... 52/408 X

*Primary Examiner*—Carl D. Friedman
*Assistant Examiner*—Creighton Smith
*Attorney, Agent, or Firm*—Ralph W. Selitto, Jr.

[57] ABSTRACT

The core of the wall construction is formed by the four layers, fibreboard (1) with inside surface coating (5) of cement, acoustic barrier layer (2) made of flexible, fibrous material, particle insulation layer (3) made of loosely blasted-in wood particles and outer covering layer (4). By this specially developed construction, a non-load-bearing external wall of a building is achieved, which has an excellent heat and sound insulation, a great heat-retention capacity of the inner layer and a fire resistance value of at least F30 despite the light construction method. The wall construction can be provided on the inside with an additional layer (6) which enhances the heat conduction and increases the conduction of heat given off by a heating device (7) into the heat-retaining fibreboard (1).

28 Claims, 1 Drawing Sheet

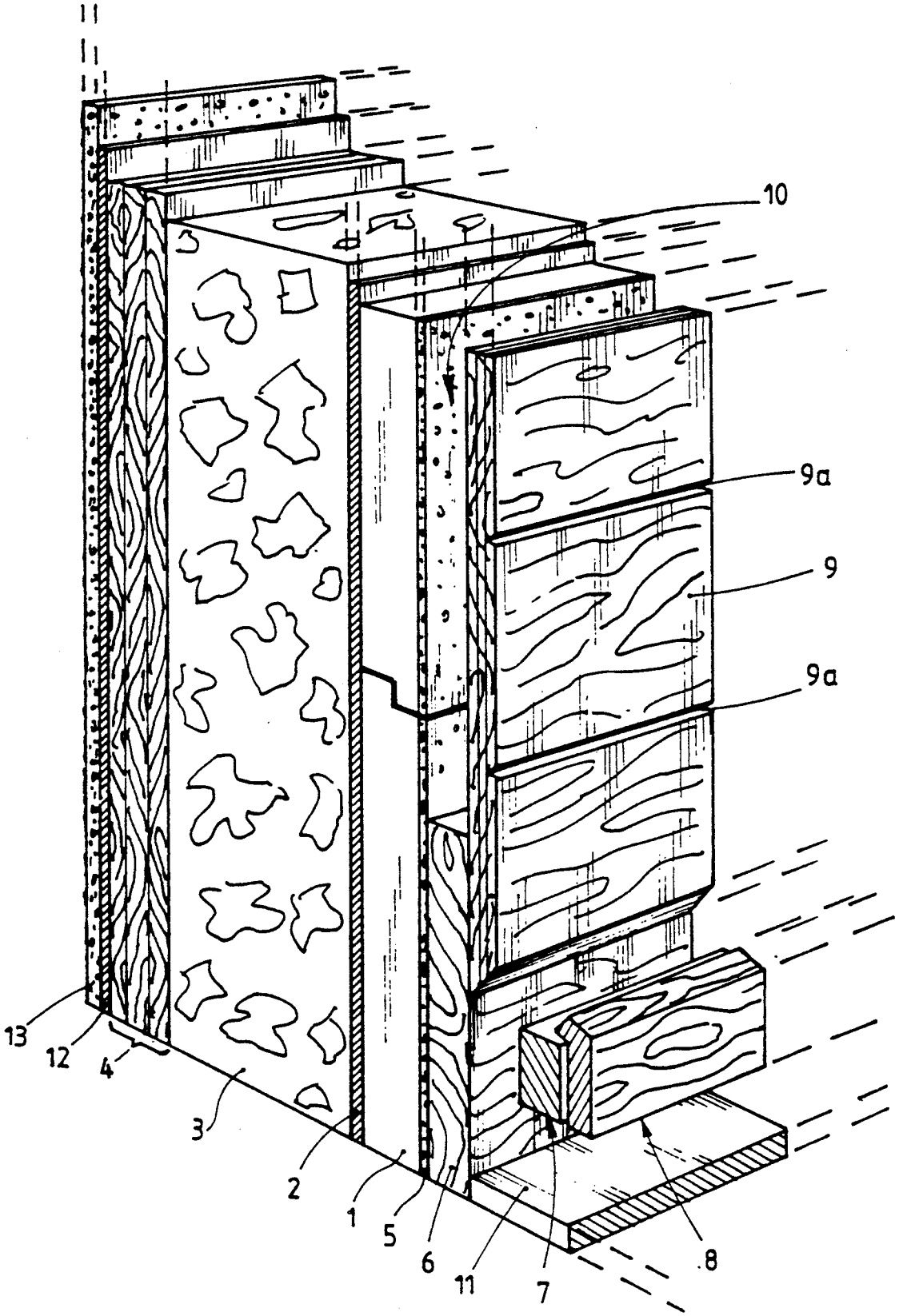
10
9a
9
9a
13
12
4
3
2
1
5
6
11
7
8

WALL CONSTRUCTION OF A NON-LOAD-BEARING EXTERNAL WALL OF A BUILDING

The invention relates to a wall construction of a non-load-bearing external wall of a building.

External walls of buildings in the so-called skeleton construction method consist of a load-bearing construction, for example a timber beam load-bearing structure, and of non-load-bearing wall constructions inserted between the load-bearing elements.

Non-load-bearing wall constructions of this type are usually built in the light construction method for practical and economic reasons. The lightweight materials used require special measures in several respects, in particular if the material used primarily is timber.

These relate firstly to additional measures for heat insulation and sound insulation. Furthermore, conventional light construction walls are not capable of retaining sufficient heat. However, a high heat-retention capacity of the external walls in particular is essential to achieve an even room climate and a balanced room temperature. And, furthermore, sufficient fireproofing, that means a fire resistance category of at least F30 (fire-retardant) to be aimed at, will also not be achieved without additional precautions in the wall construction.

The primary object of the present invention is therefore to propose a wall construction of a non-load-bearing external wall of a building, which wall construction meets the abovementioned requirements and thus results in a wall with a good heat and sound insulation, a high heat-retention capacity and a fire resistance value of at least F30. In this case, ecologically acceptable materials are to be used. At the same time, an additional aim is a rational and time-saving construction method.

This object is achieved by the characterisation specified in the independent Patent Claim 1.

With the layers inserted in the wall construction according to the invention and their interaction, the advantageous characteristics described below are achieved in particular.

The material of the fibreboard is capable of retaining heat to a desirably great extent. Additionally, this layer also acts as sound insulation. The surface coating of cement applied to its inside serves primarily for increasing the fire resistance since it seals the wall largely airtightly and is itself non-flammable.

The additionally desired good heat insulation results due to the excellent insulation effect of the particle insulation layer. In order to prevent sound propagation across the layers of the wall, a barrier layer, which is made of a soft flexible material and effectively damps soundwaves, is inserted between the fibreboards and the particle insulation layer.

Towards the outside, the wall is finished off with a large-area covering panel which completely fills or covers one or more bays or compartments of the load-bearing construction in one piece. The wall is thus airtightly sealed, by which means the fire resistance is further increased and additional precautions, such as, for example, the insertion of draughtproofing paper, are superfluous.

The use of large-area panel elements for the outer covering panels and the fibreboards as well as the blasting of the particle insulation layer directly into the built wall lead to an extremely rational and rapid construction method.

A further object of the invention consists in designing the wall construction in such a way that the heat transmission from a heating device to the wall, more precisely to the heat-retaining fibreboard, is improved.

The achievement of this object is defined in the characterising part of the dependent Patent Claim 2.

Preferred embodiments of the invention are the subject-matter of the further dependent patent claims.

An exemplary embodiment of the invention is described below with reference to the attached drawing.

The single figure of the drawing shows a perspective sectional illustration of the construction of a wall according to the invention.

The wall construction comprises as primary components a wood fibreboard 1, an acoustic barrier layer 2, a particle insulation layer 3 and an outer covering panel 4. The fibreboard 1 preferably consists of magnesitebound or cement-bound wood wool. It is provided on its inside with a surface coating 5 of cement. The acoustic barrier layer 2 is a flexible, fibrous material, for example a needled felt, a mineral fibre mat or a coir mat, which can damp soundwaves due to its softness. Loose wood particles are used for the particle insulation layer 3, specifically preferably waste wood particles which have expediently been treated with a boric salt solution in order to make them flame retardant and protect them from fungal attack. The outer covering panel 4 is a multilayered bonded wooden board.

According to a particular embodiment, the wall construction has on the inside an additional wooden lining board 6 which enhances the heat conduction. This additional layer has a heat conductivity perpendicular to the wall surface which is greater than that of customary internal wall linings. Its purpose is to increase the conduction of heat given off by a heating device 7 into the heat-retaining fibreboard 1. Consequently, the wooden lining board 6 is expediently provided only in the region between the heating device 7, for example a skirting board heating, and the wall.

The exemplary embodiment illustrated in the drawing shows a wall which is lined on the inside with a large-area, multilayered bonded wooden board 9. The latter extends from the upper region of the wooden lining board 6 up to the ceiling and is screwed, for example, to a rafter (not shown) and held on the ceiling by a blind bolt or a spring. By means of this arrangement, a cavity 10 is formed behind the wooden board. The wooden board 9 can be provided with rabbets or bevels **9*a* which give it the appearance of a panel wall. Since the depth of the notches 9*a* is only about one third of the board thickness, the wooden board 9** remains integral despite its panelling structure.

Furthermore, a wooden covering 8 for the heating device and a diagrammatically indicated floor 11 can be seen in the drawing—these are not essential in the present context.

A particular embodiment of the outside of a wall construction according to the invention can likewise be seen in the drawing. In this case, a needled felt 12 is applied to the outer covering panel 4. External plaster 13 is applied, in turn, to this needled felt. It is achieved by this arrangement that warping of the outer covering panel 4, which is preferably constructed as a wooden board, cannot lead to cracks in the external plaster 13 because the needled felt 12 is so flexible that it can in itself compensate movements of the covering panel.

A non-load-bearing wall according to the invention can expediently be built in the manner described below.

In a first stage, the outer covering panels 4 are applied to or between the supports of the load-bearing structure. Subsequently, the barrier layer 2 and the fibreboards 1 are set up with spacing from the inside. In a further stage, the wood particles of the particle insulation layer 3 are blasted into the cavity present due to the spacing between the covering panels 4 and the barrier layer 2 through an opening provided for this purpose.

I claim:

1. Wall construction of a non-load-bearing external wall of a building, characterised in that the said wall has at least the following layers one after the other seen from the inside of the outside:

a) a wood fibreboard (1), serving primarily for heat retention, having an inside surface coating (5) of cement serving for pore sealing, b) a barrier layer (2), serving primarily as an acoustic barrier, made of a flexible fibrous material, c) a material insulation layer (3), serving primarily for heat insulation, consisting of loosely blasted-in wood particles, and d) an outer covering panel (4) which extends integrally over at least one bay of the load-bearing construction.

2. Wall construction according to claim 1, characterised in that, at least in a region behind a heating device (7), which is present in the vicinity of the wall, the wall has on its inside an additional layer (6) which enhances heat conduction to the fibreboard (1), serving primarily for heat retention, and which has a heat conductivity perpendicular to the wall surface of at least 0.34 watt per meter and Kelvin.

3. Wall construction according to one of claims 1 or 2, characterised in that the outer covering panel (4) is provided on the outside with a needled felt (12).

4. Wall construction according to one of claims 1 or 2, characterised in that the barrier layer (2), serving primarily as an acoustic barrier, is a needled felt.

5. Wall construction according to one of claims 1 or 2, characterised in that the barrier layer (2), serving primarily as an acoustic barrier, is a mineral fibre mat.

6. Wall construction according to one of claims 1 or 2, characterised in that the barrier layer (2), serving primarily as an acoustic barrier, is a coir mat.

7. Wall construction according to one of claims 1 or 2, characterised in that the outer covering panel (4) is a multilayered bonded wooden board.

8. Wall construction according to claim 2, characterised in that said additional layer (6) is a wooden lining board.

9. Wall construction according to claim 2, characterised in that the wall is lined on the inside additionally with a large-area, multilayered bonded wooden board (9) which extends in the vertical direction integrally from a region near to an upper edge of the heating device (7) up to a ceiling.

10. Use of the wall construction according to claim 2 in a heating method for interior rooms, characterised in that heat given off by a heating device (7) is preferably received by said additional layer (6) and is transmitted to the fibreboard (1) serving primarily for heat retention, from where the heat is given off in delayed action to the interior room, heat losses towards the outside being insulated by means of the particle insulation layer (3).

11. Wall construction according to claim 3, characterised in that the barrier (2), serving primarily as an acoustic barrier, is a needled felt.

12. Wall construction according to claim 3, characterised in that the barrier (2), serving primarily as an acoustic barrier, is a mineral fibre mat.

13. Wall construction according to claim 3, characterised in that the barrier (2), serving primarily as an acoustic barrier, is a coir mat.

14. Wall construction according to claim 3, characterised in that the outer covering panel (4) is a multilayered bonded wooden board.

15. Wall construction according to claim 4, characterised in that the outer covering panel (4) is a multilayered bonded wooden board.

16. Wall construction according to claim 4, characterised in that the outer covering panel (4) is a multilayered bonded wooden board.

17. Wall construction according to claim 6, characterised in that the outer covering panel (4) is a multilayered bonded wooden board.

18. Wall construction according to claim 3, characterised in that said additional layer (6) is a wooden lining board.

19. Wall construction according to claim 4, characterised in that said additional layer (6) is a wooden lining board.

20. Wall construction according to claim 5, characterised in that said additional layer (6) is a wooden lining board.

21. Wall construction according to claim 6, characterised in that said additional layer (6) is a wooden lining board.

22. Wall construction according to claim 7, characterised in that said additional layer (6) is a wooden lining board.

23. Wall construction according to claim 3, characterised in that the wall is lined on the inside additionally with a large-area, multilayered bonded wooden board (9) which extends in the vertical direction integrally from a region near to an upper edge of the heating device (7) up to a ceiling.

24. Wall construction according to claim 4, characterised in that the wall is lined on the inside additionally with a large-area, multilayered bonded wooden board (9) which extends in the vertical direction integrally from a region near to an upper edge of the heating device (7) up to a ceiling.

25. Wall construction according to claim 5, characterised in that the wall is lined on the inside additionally with a large-area, multilayered bonded wooden board (9) which extends in the vertical direction integrally from a region near to an upper edge of the heating device (7) up to a ceiling.

26. Wall construction according to claim 6, characterised in that the wall is lined on the inside additionally with a large-area, multilayered bonded wooden board (9) which extends in the vertical direction integrally from a region near to an upper edge of the heating device (7) up to a ceiling.

27. Wall construction according to claim 7, characterised in that the wall is lined on the inside additionally with a large-area, multilayered bonded wooden board (9) which extends in the vertical direction integrally from a region near to an upper edge of the heating device (7) up to a ceiling.

28. Wall construction according to claim 8, characterised in that the wall is lined on the inside additionally with a large-area, multilayered bonded wooden board (9) which extends in the vertical direction integrally from a region near to an upper edge of the heating device (7) up to a ceiling.

* * * * *